US009656281B2

(12) United States Patent
Kinle

(10) Patent No.: US 9,656,281 B2
(45) Date of Patent: May 23, 2017

(54) SHOWER HEAD WITH ROTATABLE CONTROL DISK

(71) Applicant: Hansgrohe SE, Schiltach (DE)

(72) Inventor: Ulrich Kinle, Schenkenzell (DE)

(73) Assignee: HANSGROHE SE, Schiltach (DE)

( * ) Notice: Subject to any disclaimer, the term of this patent is extended or adjusted under 35 U.S.C. 154(b) by 0 days.

(21) Appl. No.: 14/786,664

(22) PCT Filed: Apr. 22, 2014

(86) PCT No.: PCT/EP2014/058086
§ 371 (c)(1),
(2) Date: Oct. 23, 2015

(87) PCT Pub. No.: WO2014/173871
PCT Pub. Date: Oct. 30, 2014

(65) Prior Publication Data

US 2016/0107175 A1 Apr. 21, 2016

(30) Foreign Application Priority Data

Apr. 26, 2013 (DE) ..... 10 2013 207 679

(51) Int. Cl.
*B05B 1/16* (2006.01)
*B05B 1/18* (2006.01)
(Continued)

(52) U.S. Cl.
CPC ..... *B05B 1/185* (2013.01); *B05B 1/083* (2013.01); *B05B 1/1636* (2013.01); *B05B 1/267* (2013.01);
(Continued)

(58) Field of Classification Search
CPC ..... B05B 1/083; B05B 1/1636; B05B 1/18; B05B 1/185; B05B 1/267; B05B 1/30; B05B 3/04; E03C 1/0409
(Continued)

(56) References Cited

U.S. PATENT DOCUMENTS 2,878,066 A 3/1959 Erwin
3,713,587 A * 1/1973 Carson ..... B05B 1/1645 239/383
(Continued)

FOREIGN PATENT DOCUMENTS

CN 200995177 Y 12/2007
CN 201042680 Y 4/2008
(Continued)

OTHER PUBLICATIONS

Official Action of Jan. 28, 2014 in DE 10 2013 207 679.7.

*Primary Examiner* — Darren W Gorman
(74) *Attorney, Agent, or Firm* — Duane Morris LLP

(57) ABSTRACT

A shower head jet disk (4) has inlet and outlet openings (8, 9) on opposite sides, with a passage duct (10*a*, 10*b*) fluidically connecting each outlet to at least one inlet. An upstream control disk (2) is rotatable relative to the jet disk and has a control slot pattern (131, 134) opening the inlets depending on the rotational position of the control disk. The control slot pattern and the inlets are coordinated such that two adjacent inlet openings (8*a*, 8*b*) that correspond with a common outlet opening (9) via two passage ducts (10*a*, 10*b*) with non-parallel side walls (12*a*, 12*b*) provide different jet outlet directions (Sa, Sb), or two regions of an inlet opening that corresponds with an outlet opening via a passage duct with non-parallel side wall regions provide different jet
(Continued)

Figure 1:
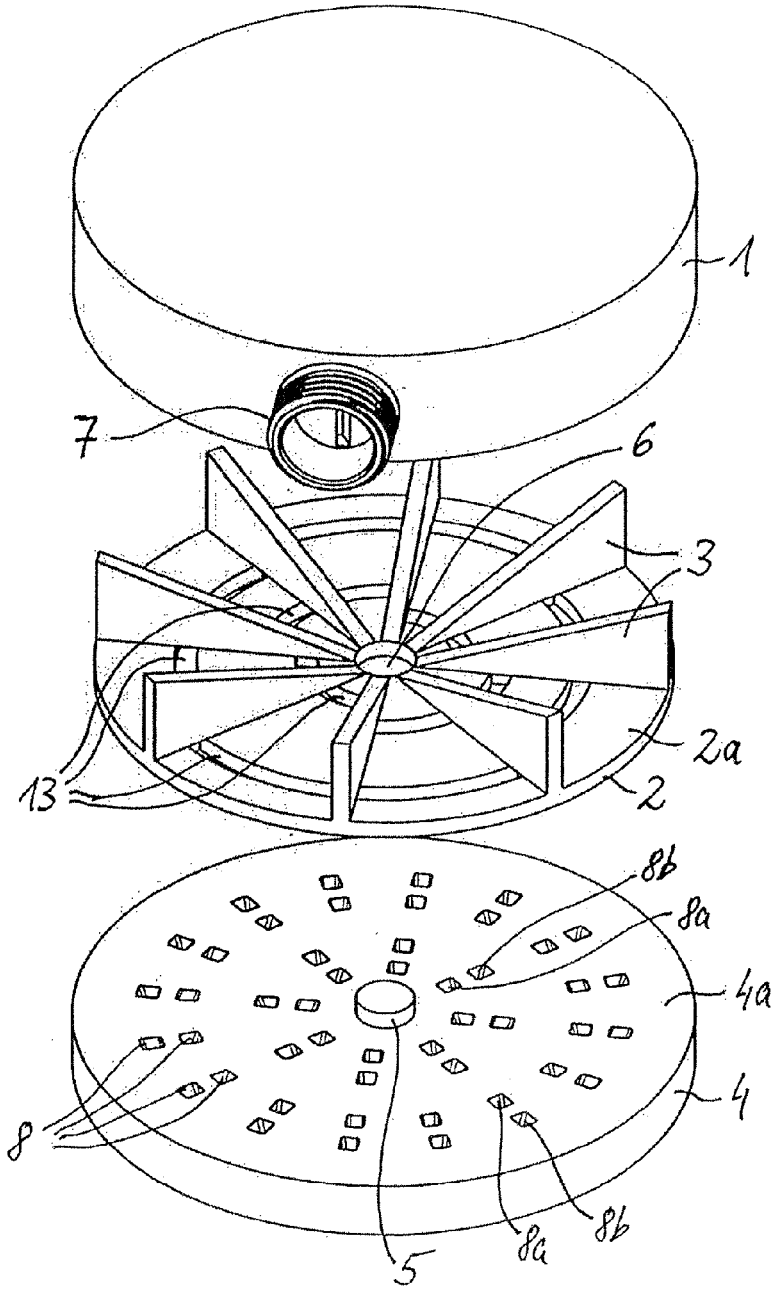

directions, or two adjacent inlet openings that correspond with two adjacent outlet openings are opened, in alternating fashion.

20 Claims, 14 Drawing Sheets

(51) Int. Cl.
*B05B 1/26* (2006.01)
*B05B 3/04* (2006.01)
*E03C 1/04* (2006.01)
*B05B 1/08* (2006.01)
*B05B 1/30* (2006.01)

(52) U.S. Cl.
CPC ..... *B05B 1/30* (2013.01); *B05B 3/04* (2013.01); *E03C 1/0409* (2013.01)

(58) Field of Classification Search
USPC ..... 239/99, 101, 380–383, 556, 558, 562, 239/563
See application file for complete search history.

(56) References Cited

U.S. PATENT DOCUMENTS 4,330,089 A 5/1982 Finkbeiner
4,398,669 A * 8/1983 Fienhold ..... B05B 1/1654 239/447
4,629,125 A * 12/1986 Liu ..... B05B 1/1636 239/383
5,967,417 A * 10/1999 Mantel ..... B05B 3/04 239/380
6,098,899 A * 8/2000 Rosenberg ..... B05B 1/083 239/382
9,067,222 B2 6/2015 Gransow et al.
2006/0032945 A1 2/2006 Clearman et al.
2008/0156897 A1* 7/2008 Leber ..... B05B 3/04 239/101
2010/0127096 A1 5/2010 Leber
2012/0181353 A1* 7/2012 Zhou ..... A61H 9/0021 239/101

FOREIGN PATENT DOCUMENTS

CN 202555429 U 11/2012
DE 102008015969 A1 9/2009
DE 102008015970 A1 9/2009
EP 0900597 B1 10/1999
WO 0010720 A1 3/2000

* cited by examiner

Fig. 22
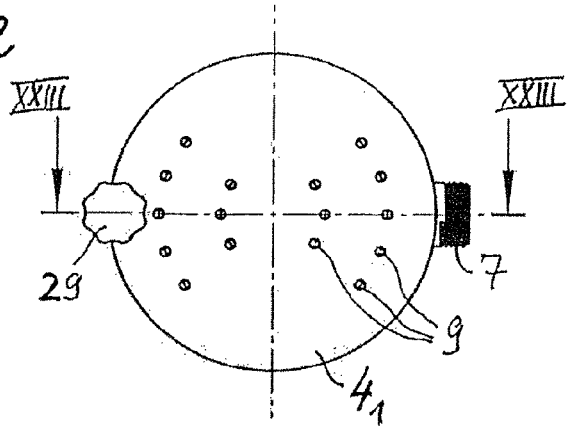
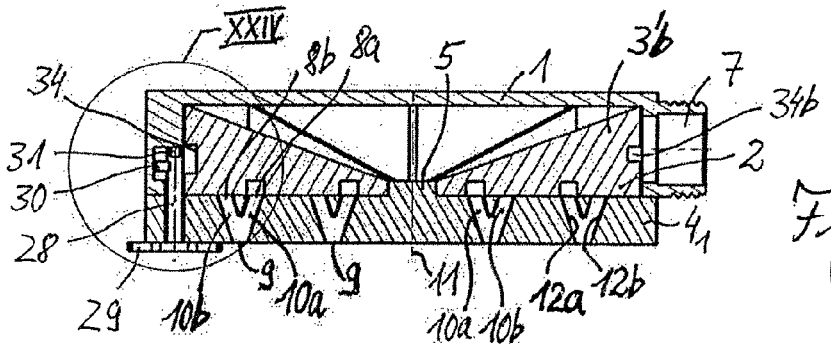
Fig. 23
Fig. 24
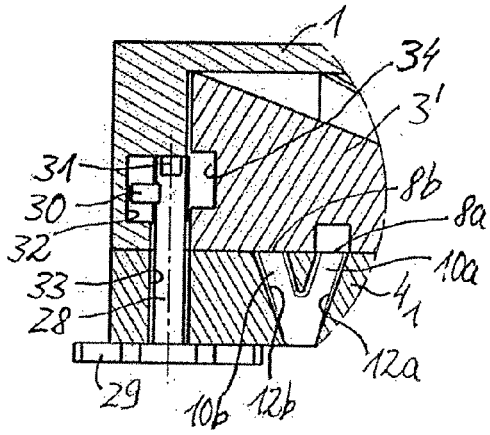
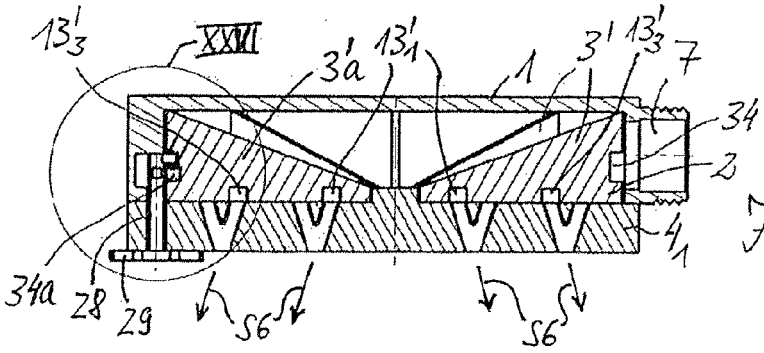
Fig. 25

SHOWER HEAD WITH ROTATABLE CONTROL DISK

The invention relates to a shower head, which shower head comprises a jet disk with inlet openings and outlet openings on opposite disk sides and with in each case one passage channel for connecting each outlet opening to at least one inlet opening, and which shower head comprises a control disk which is arranged upstream of the jet disk as viewed in the fluid flow direction and so as to be rotatably movable relative to said jet disk and which has a control slot pattern for opening up the inlet openings in a manner dependent on the rotational position of the control disk.

Shower heads of said type are used for example in the sanitary sector for handheld and overhead shower devices of shower and bath systems. Through the use of the control disk that is rotatably movable relative to the jet disk, the shower jet characteristic, that is to say the jet discharge characteristic of the shower head, can be configured so as to vary with time, which can be utilized for example to achieve a massage effect.

A shower head of said type is disclosed in the patent publication EP 0 900 597 B1. In the case of the shower head in said document, the function of a jet disk is performed by a rotor which is provided with a turbine blade structure and which has a closure element which extends in the circumferential direction over approximately half of the circumferential length. The jet disk is provided with passage channels which are of circular cross section and which, as the fluid-driven rotor rotates, are successively opened up or blocked by the closure element, wherein the closure element blocks or opens up in each case approximately half of the passage channels.

Various shower heads have also already been proposed which, for the variation of the shower jet characteristic with time, are equipped with movable jet outlet elements which are mounted rotatably and/or pivotably on a jet disk body, see for example the laid-open specifications DE 10 2008 015 970 A1, WO 00/10720 A1 and US 2006/0032945 A1 and the patent publication DE 10 2011 013 534 B3. Shower heads of said type require a corresponding number of jet outlet elements, which must be movably mounted in the jet disk body, and a relatively complex drive for said movable jet outlet elements.

The invention is based on the technical problem of providing a shower head of the type mentioned at the outset which permits an advantageous variation of the shower jet characteristic with time with relatively little outlay.

The invention solves said problem through the provision of a shower head having the features of claim 1. In the case of this shower head, the control slot pattern and the inlet openings of the jet disk are coordinated with one another such that, as the control disk rotates, two adjacent inlet openings which correspond to a common outlet opening via two passage channels with non-parallel side walls for providing two different jet outlet directions, or two regions of an inlet opening which corresponds with an outlet opening via a passage channel with non-parallel side wall regions for providing two different jet outlet directions, or two adjacent inlet openings which correspond to two adjacent outlet openings, are opened up in alternating fashion.

This alternating and successive opening-up and blocking of the inlet openings or inlet opening regions assigned to a common outlet opening, or of inlet openings assigned to two preferably closely adjacent outlet openings, as the control disk rotates ensures the desired variation of the jet characteristic with time in the case of the shower head according to the invention, without the need for cumbersome jet outlet elements mounted in rotatable movable fashion on the jet disk body to be provided for this purpose. The shower head according to the invention therefore makes do with relatively few individual parts and with relatively few movable parts. The variability of the jet pattern is achieved not by way of a multiplicity of movable jet outlet elements or jet nozzles but by way of a periodically alternating blocking and opening-up of adjacent inlet openings or inlet regions of the jet disk which correspond to a common outlet opening or to two closely adjacent outlet openings. In this way, the fluid, depending on whether it passes into the jet disk through one or the other inlet opening or through one or the other inlet opening region, can emerge from the jet disk with a different outlet characteristic and/or at an offset position. During the operation of the shower head, as the control disk continuously rotates, different jet patterns of the fluid jet emerging from the shower head periodically alternate, wherein the different jet patterns are, during every complete rotation of the control disk, generated by way of the alternating opening-up and blocking of the various inlet openings or inlet opening regions by means of the control slot pattern.

In a refinement of the invention, the adjacent inlet openings or inlet opening regions are arranged on different radii of the jet disk, and the control slot pattern comprises slot regions correspondingly arranged on different radii. This constitutes a structurally advantageous implementation of the desired functionality whereby the adjacent inlet openings or inlet opening regions are opened up and blocked in alternating fashion as the control disk rotates. In a refinement of said measure, for this purpose, the control slot pattern comprises separate slot segments which are arranged on different radii and which are assigned to in each case one of the two adjacent inlet openings or inlet opening regions, and/or at least one slot which extends in the circumferential and radial directions of the control disk and which is assigned to both of the adjacent inlet openings or inlet opening regions. In a further refinement of this measure, the control slot pattern comprises a slot which is continuous in the circumferential direction and which is bridged by at least one bridge web, and/or slots which extend in the circumferential direction and which are separated from one another by one or more separation webs. Here, a separation web is to be understood to mean a relatively narrow web which interrupts the slot and thereby connects a radially inner control disk region to a radially outer control disk region. The width of the separation web is preferably at most approximately equal to the width of the slot.

In a refinement of the invention, at least one of the passage channels has, in a jet disk radial plane, a cross section which narrows conically toward the outlet opening. A passage channel of said type can assign to an outlet opening an inlet opening which is of greater extent in a radial direction, the radially inner region and radially outer region of which inlet opening may function as the inlet opening regions situated at different radii.

In a refinement of the invention, the control disk is driven, in the manner of a turbine, by the fluid flow. For this purpose, said control disk may be equipped, on its side facing away from the jet disk, with a corresponding turbine blade structure. Alternatively, the control disk may be coupled by way of a gearing to a turbine wheel which is driven by the fluid flow and which is arranged with the gearing on that side of the control disk which faces away from the jet disk. In a further refinement, the slot pattern of the control disk may be arranged radially outside the turbine wheel and the gearing, such that the jet control by way of the control disk can remain free from the influence of the gearing and of the turbine wheel. In another refinement, the gearing is a planetary gearing having a sun gear provided on the turbine wheel, having an outer internal gear provided on the control disk, and having at least one interposed planet gear. A gearing of said type can, in a simple manner in terms of construction, ensure a desired speed reduction of the turbine wheel rotational movement.

In a refinement of the invention, the shower head comprises a manually actuable blocking mechanism for blocking the control disk rotational movement in a first blocking position, in which one of the two adjacent inlet openings or inlet opening regions is opened up, and/or a second blocking position, in which the other of the two adjacent inlet openings or inlet opening regions is opened up. With the blocking mechanism, it is possible for a user to intentionally stop the control disk rotation during operation, in order thereby to maintain a jet pattern associated with the corresponding blocking position of the control disk.

In a refinement of said measure, the blocking mechanism comprises a manually actuable blocking pin which is held in movable fashion on the jet disk and which can be switched successively between at least three different positions, of which a first position permits the rotational movement of the control disk and the two other positions hold the control disk in its first or second blocking position respectively. For this purpose, the blocking pin may be placed into the different positions for example by way of a rotational movement and/or an axial movement and equipped with multiple blocking stops arranged offset with respect to one another in the circumferential and/or radial direction of said blocking pin, which blocking stops interact with corresponding counterpart stops on the control disk or on the turbine blade structure thereof.

Figure 2:
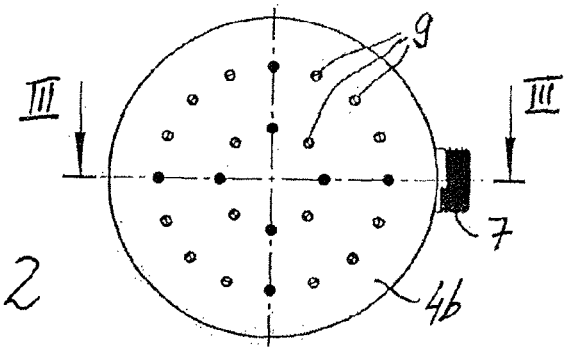
Figure 3:
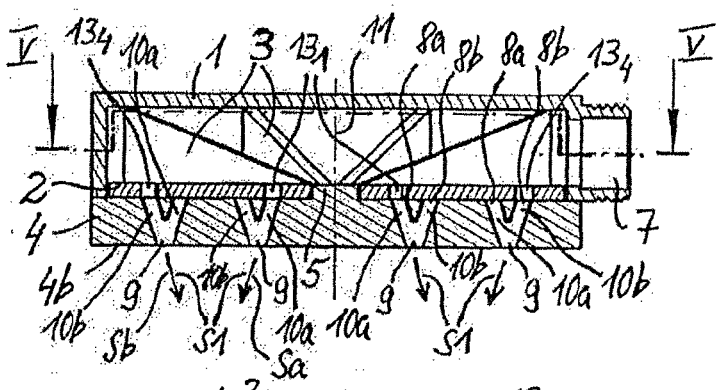
Figure 4:
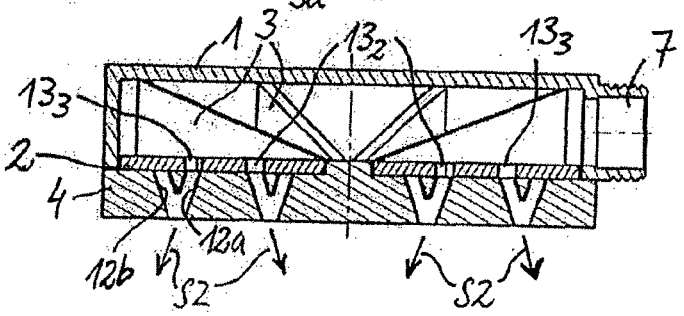
Figure 5:
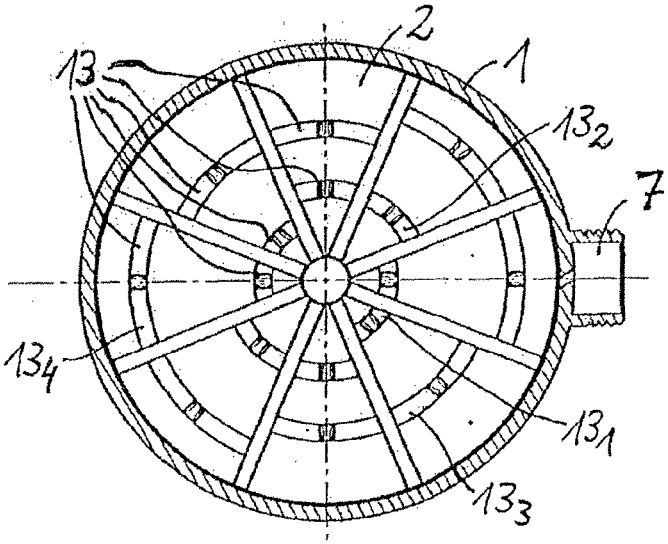
Figure 6:
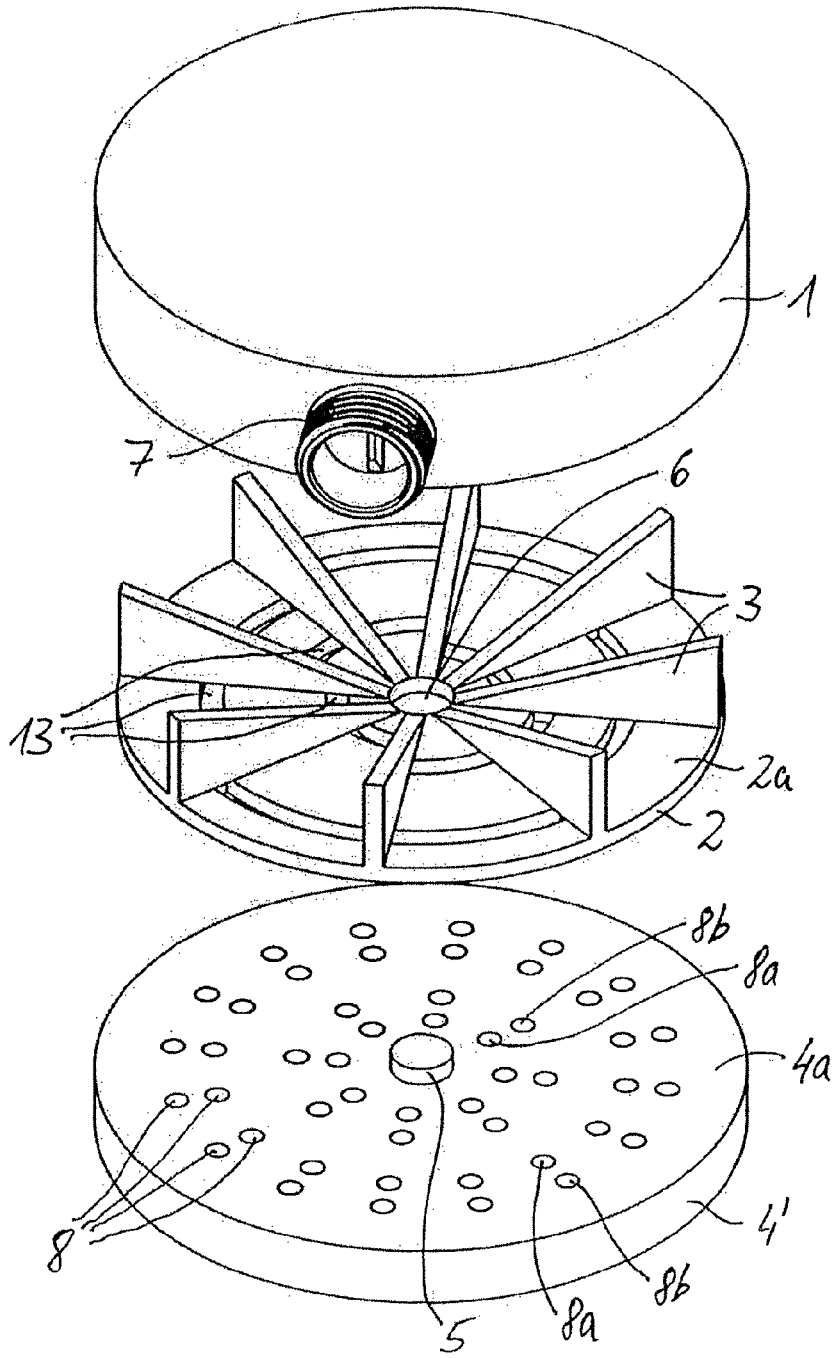
Figure 7:
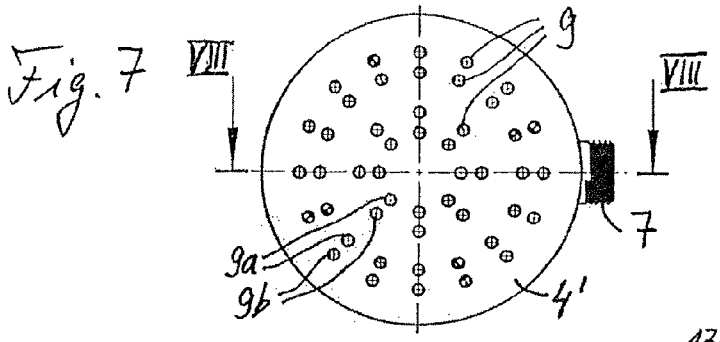
Figure 8:
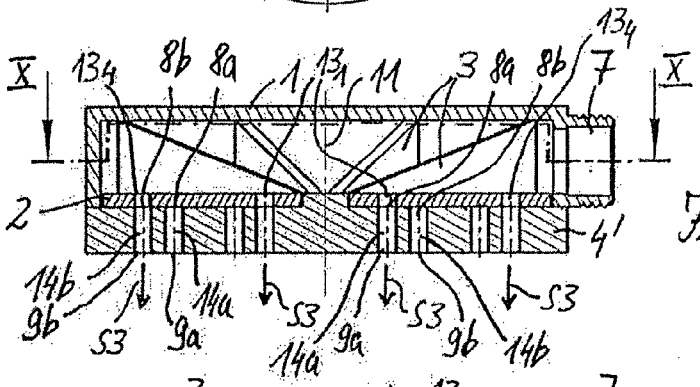
Figure 9:
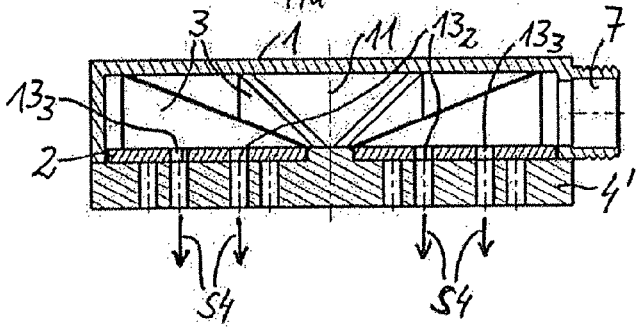
Figure 10:
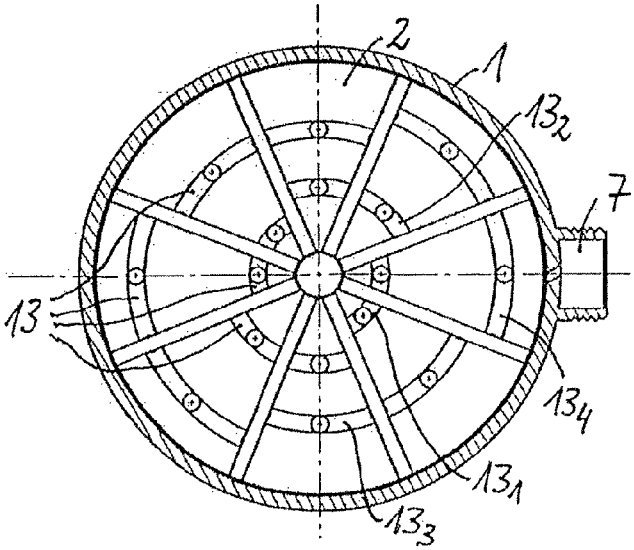
Figure 11:
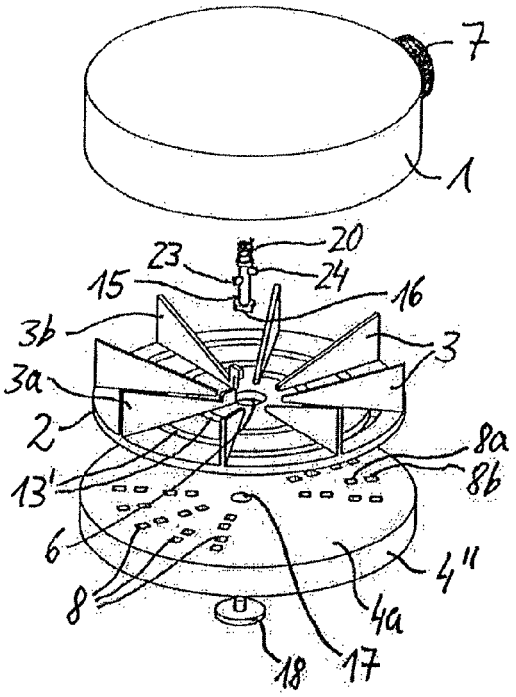
Figure 12:
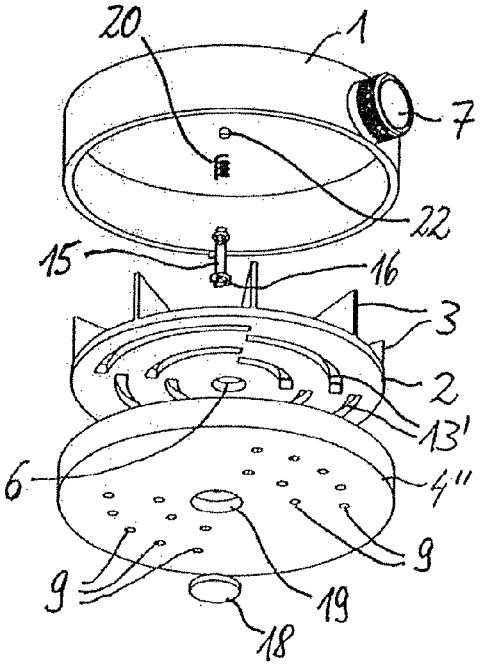
Figure 13:
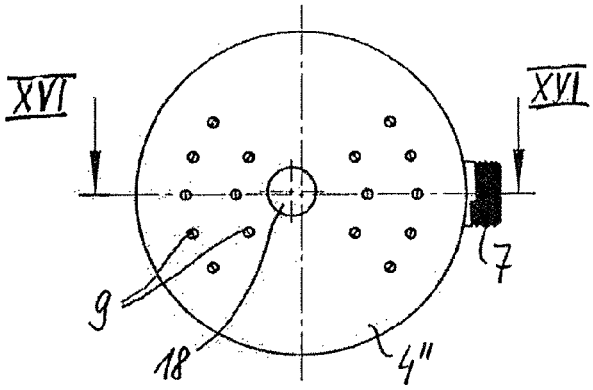
Figure 14:
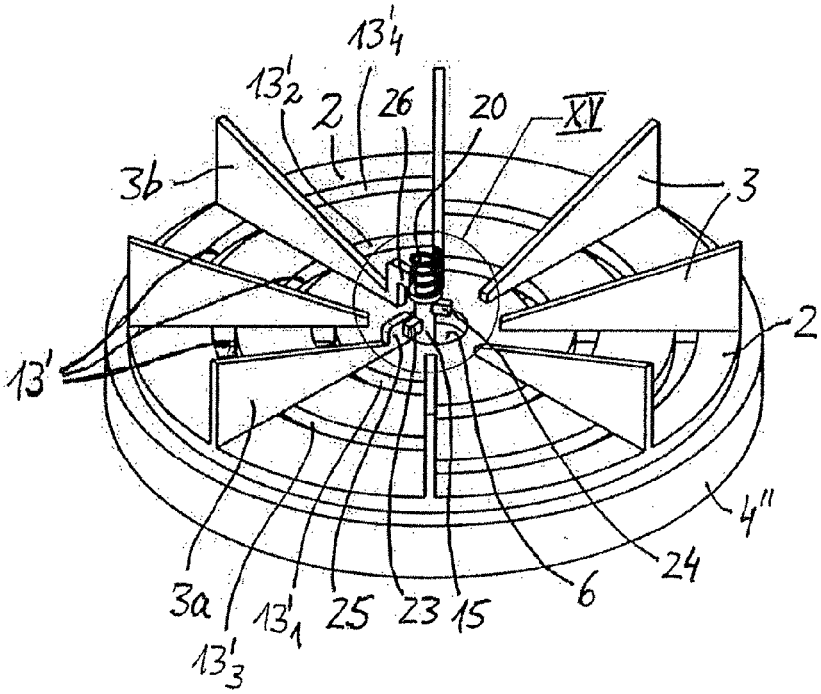
Figure 15:
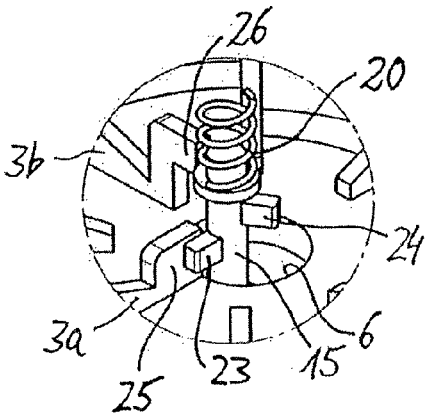
Figure 16:
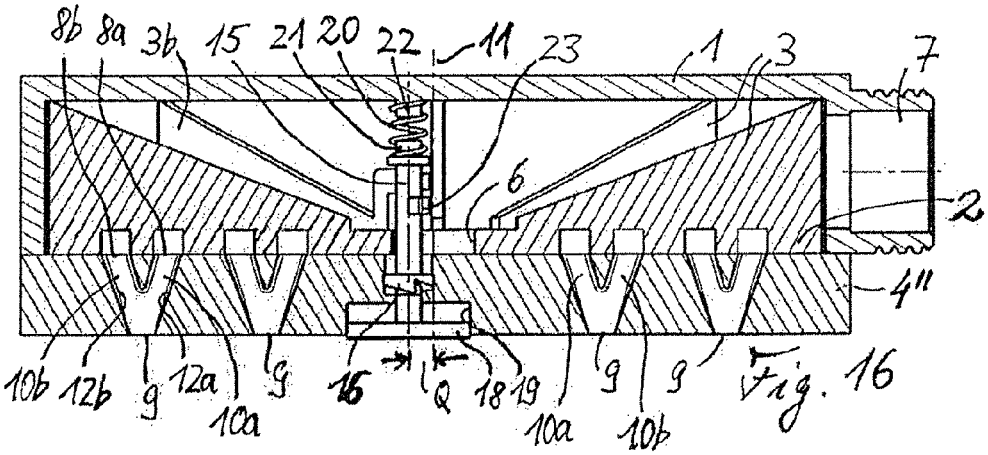
Figure 17:
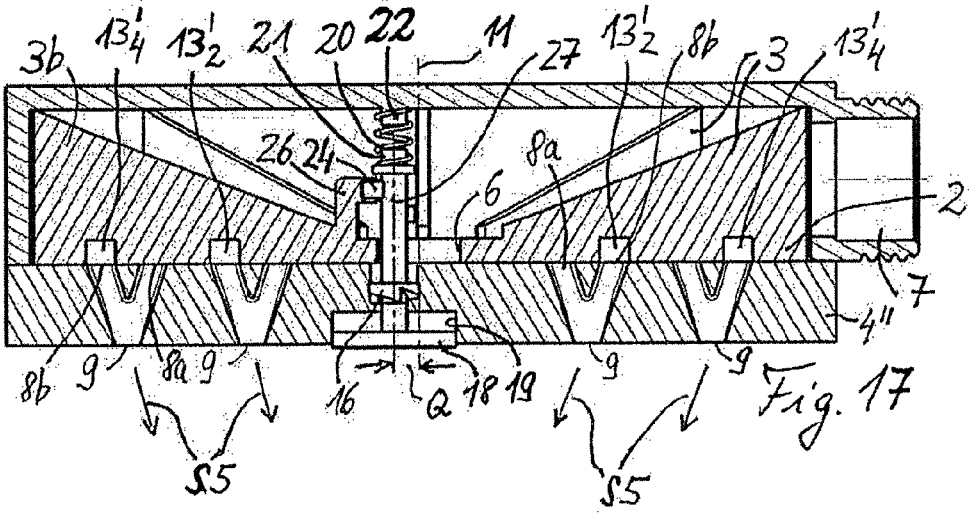
Figure 18:
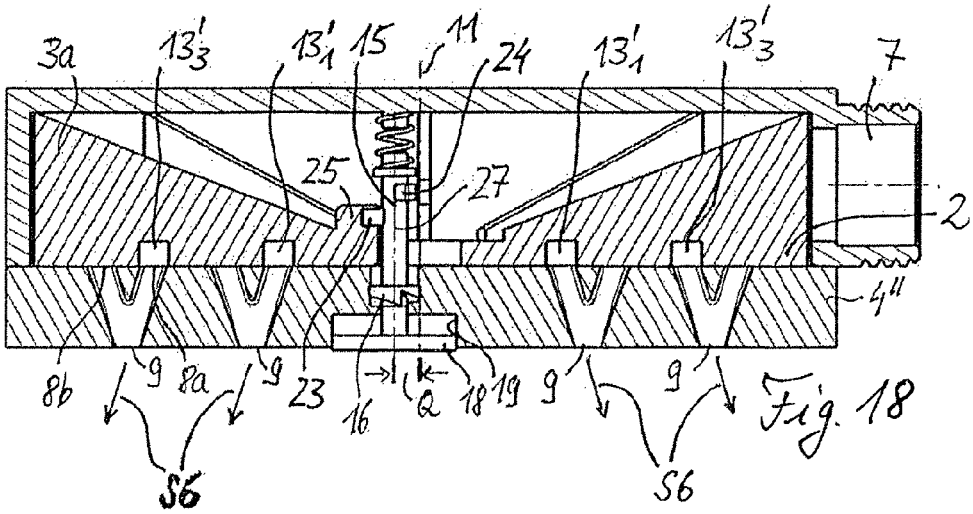
Figure 19:
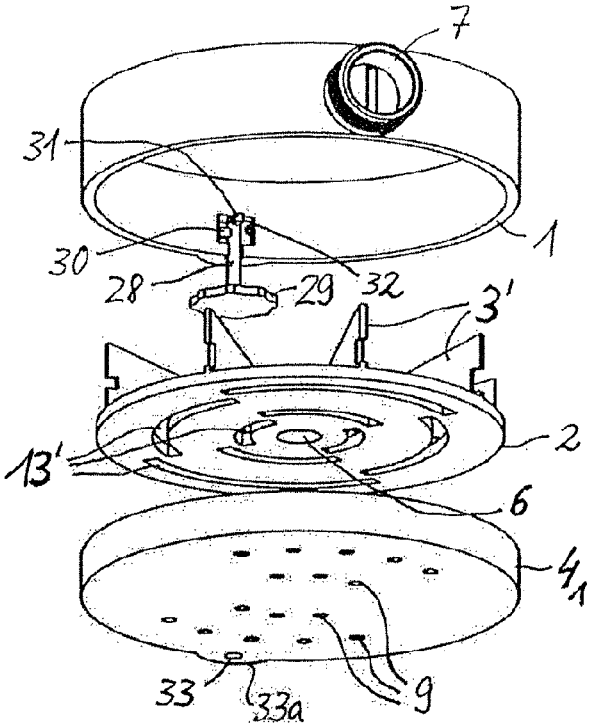
Figure 20:
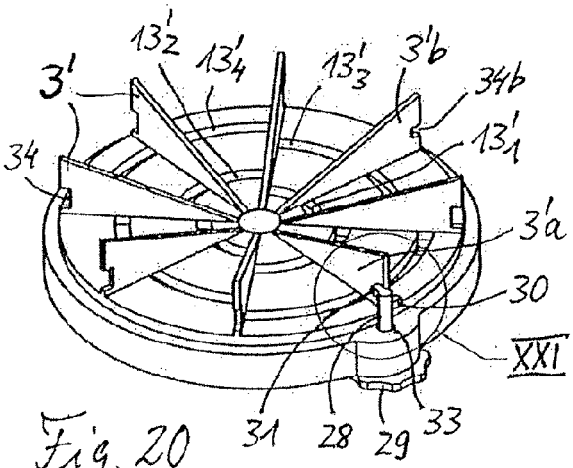
Figure 21:
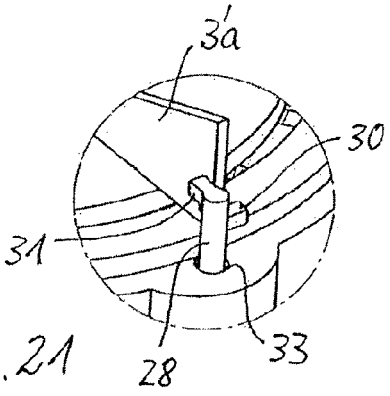
Figure 26:
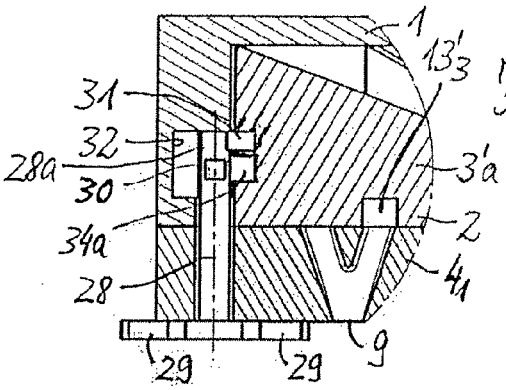
Figure 27:
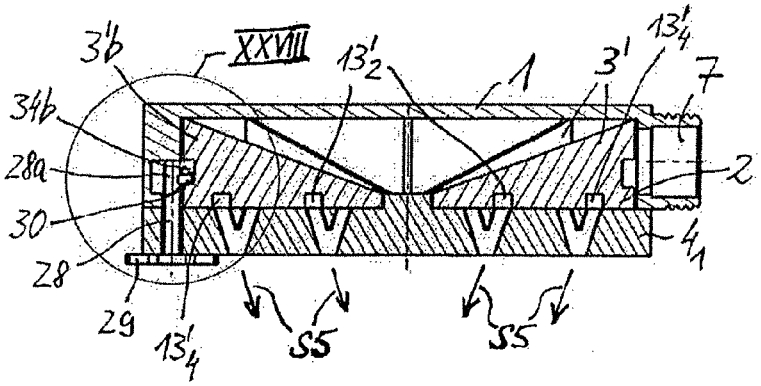
Figure 28:
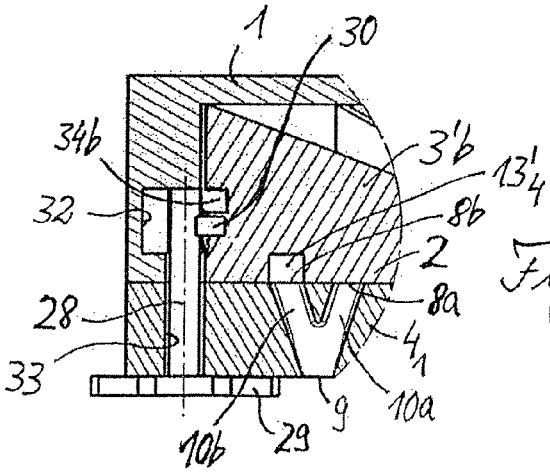
Figure 29:
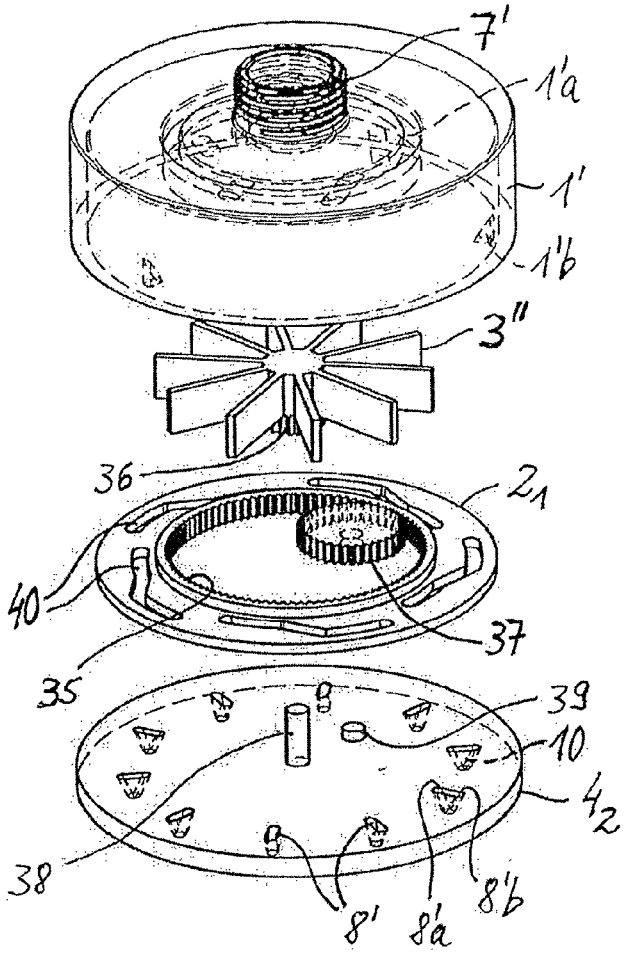
Figure 30:
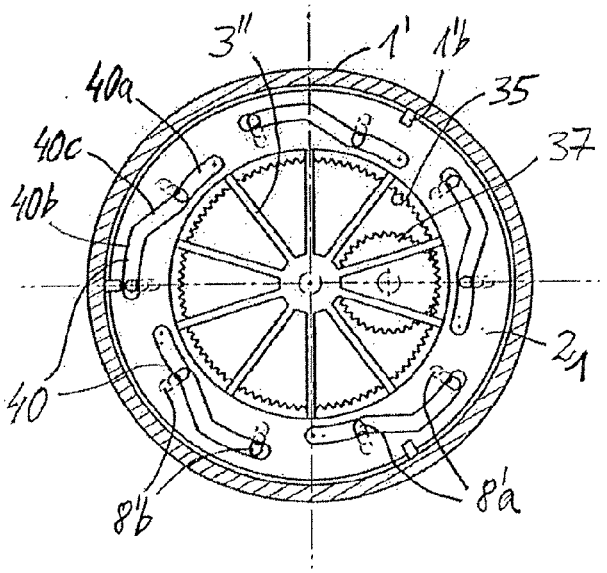
Figure 31:
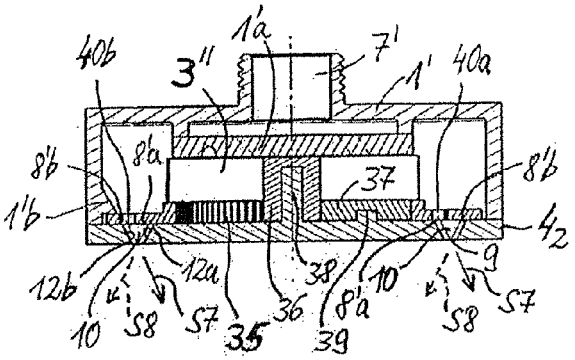
Figure 32:
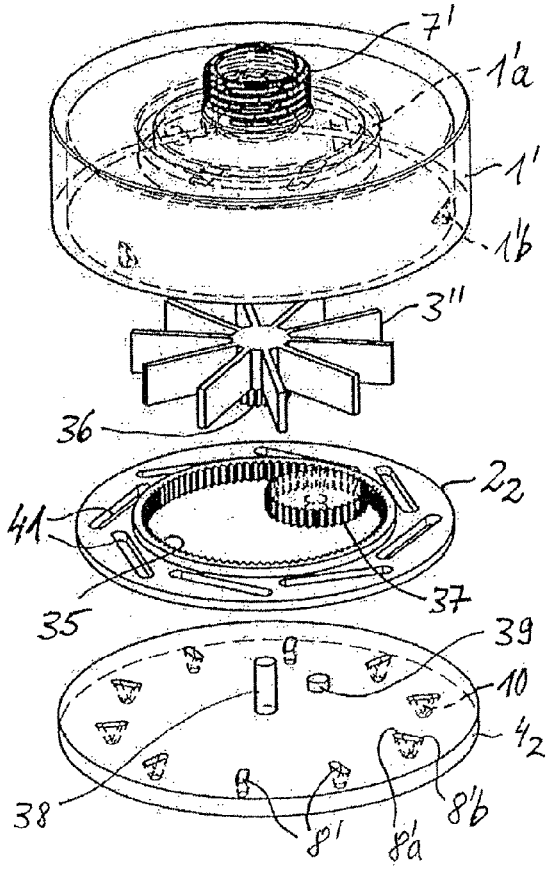
Figure 33:
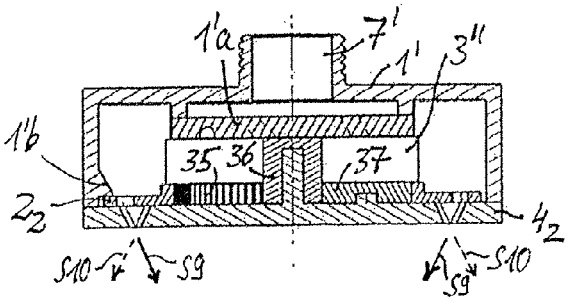
Figure 34:
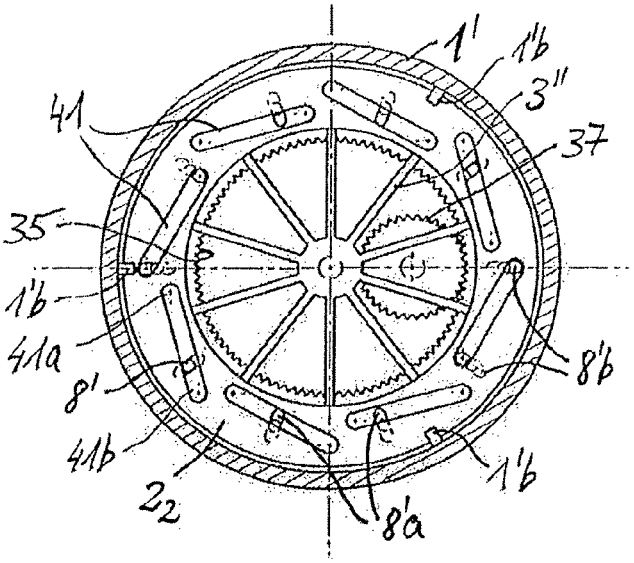
Figure 35:
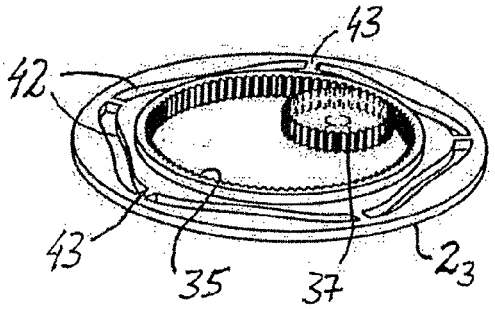
Figure 36:
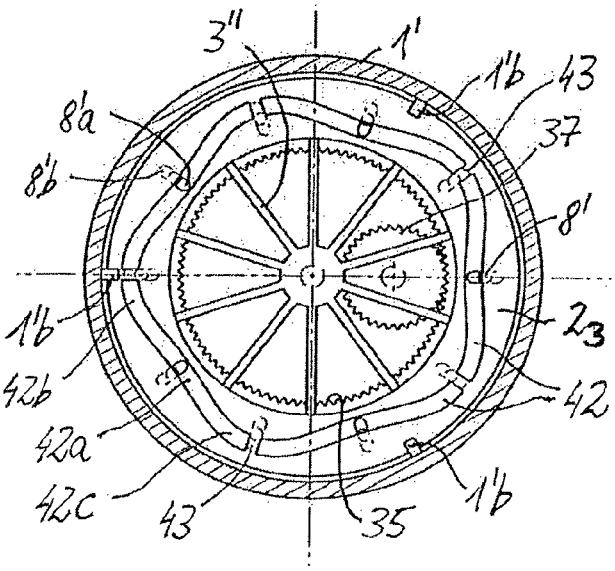
Figure 37:
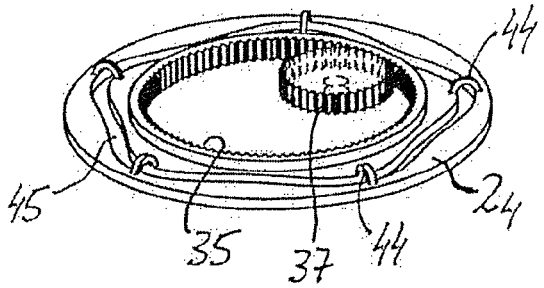
Figure 38:
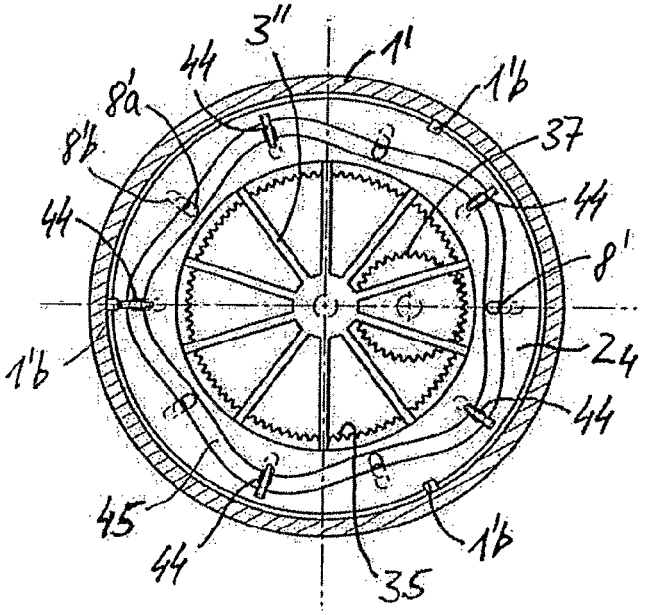

Advantageous embodiments of the invention are illustrated in the drawings and will be described below. In the drawings:

FIG. 1 shows a perspective exploded view of a first shower head with a jet disk with in each case two adjacent inlet openings per outlet opening, FIG. 2 shows a plan view from below of the shower head from FIG. 1, FIG. 3 shows a sectional view along a line III-III in FIG. 2 in a control disk position for a first shower jet characteristic, FIG. 4 shows the view of FIG. 3 in a control disk position for a second shower jet characteristic, FIG. 5 shows a sectional view along a line V-V in FIG. 3, FIG. 6 shows a perspective exploded view of a second shower head with pairs of closely adjacent inlet and outlet openings in the jet disk, FIG. 7 shows a plan view from below of the shower head from FIG. 6, FIG. 8 shows a sectional view along a line VIII-VIII in FIG. 7 in a control disk position for a first shower jet characteristic, FIG. 9 shows the view of FIG. 8 in a control disk position for a second shower jet characteristic, FIG. 10 shows a sectional view along a line X-X in FIG. 8, FIG. 11 shows a perspective exploded view from above of a third shower head with a blocking mechanism arranged in a central region, FIG. 12 shows a perspective exploded view from below of the shower head from FIG. 11, FIG. 13 shows a plan view from below of the shower head from FIG. 11, FIG. 14 shows a perspective view of the shower head of FIG. 11 with the shower head housing removed, FIG. 15 shows a detail view of a region XV in FIG. 14, FIG. 16 shows a sectional view along a line XVI-XVI in FIG. 13 with the blocking mechanism in a release position, FIG. 17 shows the view of FIG. 16 in a first blocking position for a first shower jet characteristic, FIG. 18 shows the view of FIG. 16 in a second blocking position of the blocking mechanism for a second shower jet characteristic, FIG. 19 shows a perspective exploded view from below of a fourth shower head with a blocking mechanism arranged in an edge region, FIG. 20 shows a perspective view from above of the shower head of FIG. 19 with the shower head housing removed, FIG. 21 shows a detail view of a region XXI in FIG. 20, FIG. 22 shows a plan view from below of the shower head from FIG. 19, FIG. 23 shows a sectional view along a line XXIII-XXIII in FIG. 22 with the blocking mechanism in a release position, FIG. 24 shows a detail view of a region XXIV in FIG. 23, FIG. 25 shows the view of FIG. 23 in a first blocking position of the blocking mechanism, FIG. 26 shows a detail view of a region XXVI in FIG. 25, FIG. 27 shows the view of FIG. 23 in a second blocking position of the blocking mechanism, FIG. 28 shows a detail view of a region XXVIII in FIG. 27, FIG. 29 shows a perspective view of a fifth shower head with planetary gearing and conical control disk passage channels, FIG. 30 shows a cross-sectional view similar to FIG. 5 for the shower head of FIG. 29, FIG. 31 shows a longitudinal sectional view similar to FIG. 3 for the shower head of FIG. 29, FIG. 32 shows a perspective exploded view of a sixth shower head with a control slot variant in relation to the fifth shower head, FIG. 33 shows a longitudinal sectional view similar to FIG. 31 for the shower head of FIG. 32, FIG. 34 shows a cross-sectional view similar to FIG. 30 for the shower head of FIG. 32, FIG. 35 shows a perspective view of a control disk with associated planetary gearing part for a further control slot variant of the shower heads of FIGS. 29 and 32, FIG. 36 shows a cross-sectional view similar to FIGS. 30 and 34 for a seventh shower head with the control disk variant of FIG. 35, FIG. 37 shows a perspective view of a further control disk variant with associated planetary gearing part, and FIG. 38 shows a cross-sectional view similar to FIG. 36 for an eighth shower head with the control disk variant of FIG. 37.

A shower head shown as a first exemplary embodiment according to the invention in FIGS. 1 to 5 comprises a pot-shaped shower head housing 1, a control disk 2 which is accommodated in said shower head housing and which has a turbine blade structure 3 formed integrally on an inner side 2*a*, and a jet disk 4 which bears by way of an inlet side 4*a* against the outer side of the control disk 2. The jet disk 4 is rigidly connected to the housing 1, and the control disk 2 is held, rotatably relative to said housing, in the shower head interior formed by the housing 1 and by the jet disk 4. For this purpose, a cylindrical bearing projection 5 formed on the inlet or inner side 4*a* of the jet disk 4 engages into a corresponding central opening 6 of the control disk 2.

The shower head housing 1 has a fluid inlet 7 on the side, that is to say on the circumference. In a manner known per se, the inlet 7 is assigned, on the inside of the housing 1, a flow-guiding structure by means of which the fluid supplied via the inlet 7 is directed onto the turbine blade structure 3 with a circumferential direction component, whereby the control disk 2 is set in rotation. In this way, the supplied fluid flow, which in the case of a sanitary shower device is a water flow, is utilized as a drive medium which sets the control disk 2 in rotation. The turbine blade structure 3 comprises a plurality of turbine blades which are arranged in distributed fashion in the circumferential direction and which run in an ascending, wedge-shaped manner in the radial direction such that the fluid supplied via the lateral inlet 7 can be distributed across the entire housing interior.

The jet disk 4 is equipped with a plurality of inlet openings 8 on its inlet side 4*a* and with a multiplicity of outlet openings 9 on its outlet side 4*b*. Here, as can be seen in particular from FIGS. 3 and 4, in each case two radially adjacent inlet openings 8*a*, 8*b* issue via in each case one associated passage channel 10*a*, 10*b* into a common outlet opening 9. For this purpose, the two passage channels 10*a*, 10*b* run, with longitudinal axes inclined with respect to one another, through the jet disk 4 from the inlet side 4*a* to the outlet side 4*b* of said jet disk. In the example shown, the longitudinal axes of every two passage channels 10*a*, 10*b* that lead from two radially adjacent inlet openings 8*a*, 8*b* to a common outlet opening 9 are inclined relative to a longitudinal axis 11 of the shower head by the same angle, for example by an angle of between 5° and 30°. Correspondingly, the two passage channels 10*a*, 10*b* leading from two radially adjacent inlet openings 8*a*, 8*b* to a common associated outlet opening 9 of the jet disk 4 have non-parallel side wall regions 12*a*, 12*b*.

The control disk 2 is equipped with a control slot pattern 13, wherein the control slot pattern 13 and the inlet openings 8 of the jet disk 4 are coordinated with one another such that, as the control disk 2 rotates, the two radially adjacent inlet openings 8*a*, 8*b* that issue into a common outlet opening 9 are opened up in an alternating manner. This means that, during one full rotation of the control disk 2, the control slot pattern 13 thereof opens up one of the two adjacent inlet openings 8*a*, 8*b* over a certain first angle range, and opens up the other of the two inlet openings 8*a*, 8*b* over a certain second angle range that differs from the first angle range, while covering the respective inlet opening, that is to say keeping the respective inlet opening closed, over the remaining angle range.

In the exemplary embodiment shown, the jet disk outlet openings 9 are arranged at two different radii, with a first group of eight outlet openings 9 on an inner radius, and a second group of sixteen outlet openings 9 on an outer radius. Correspondingly, on the inlet side 4*a* of the jet disk 4, eight pairs of radially adjacent inlet openings 8*a*, 8*b* are arranged in a region situated radially further toward the inside, and sixteen pairs of radially adjacent inlet openings 8*a*, 8*b* are arranged in a region situated radially further toward the outside. The inlet openings 8 are therefore situated along a total of four different radii. Correspondingly, the control slot pattern 13 of the control disk 2 has slot regions $\mathbf{13}_1$, $\mathbf{13}_2$, $\mathbf{13}_3$, $\mathbf{13}_4$ arranged on four different radii, said slot regions being in the form of slot segments. For each of the four radii, there are provided in each case two slot segments $\mathbf{13}_1$ to $\mathbf{13}_4$ which extend in each case over an angle range of 90° and are separated from one another by means of in each case two non-slotted 90° segments. Here, the slot segments $\mathbf{13}_1$, $\mathbf{13}_2$ and $\mathbf{13}_3$, $\mathbf{13}_4$ which are respectively associated with the paired inlet openings 8*a*, 8*b* and which are correspondingly situated on respectively adjacent radii are arranged offset relative to one another by 90°, such that, of the two paired inlet openings 8*a*, 8*b*, always in each case one is opened up by the control slot pattern 13 and the other is covered.

In alternative embodiments, an overlap of the slot regions may be provided such that, of the paired inlet openings 8*a*, 8*b* that issue into the same outlet opening 9, in each case one is already at least partially opened up before the other is fully covered. Depending on the configuration of such an overlap region, it is possible to achieve a more abrupt or more uniform transition between the correspondingly different shower jet characteristics.

Furthermore, in the exemplary embodiment shown, the slot segments $\mathbf{13}_1$, $\mathbf{13}_3$ belonging to the innermost radius and to the third-innermost radius, and thus in each case to the radially inner inlet openings 8*a* of the inlet opening pairs 8*a*, 8*b*, are offset relative to one another by 45°, as can be seen in particular in FIG. 5. The slot patterns $\mathbf{13}_2$, $\mathbf{13}_4$ of the second-innermost and of the outermost radii, which slot patterns correspond to the outer inlet openings 8*b* of the inlet opening pairs 8*a*, 8*b*, are likewise arranged so as to be offset relative to one another by 45°.

This coordination, selected in the exemplary embodiment of FIGS. 1 to 5, of control slot pattern 13 and inlet openings 8 has the effect that the shower jet characteristic changes in each case after a rotation of the control disk 2 through 45°, giving rise to a total of four different shower jet characteristics, each of which arises two times during one full rotation of the control disk 2. This is because, owing to the non-parallel side wall regions 12*a*, 12*b* of the two passage channels 10*a*, 10*b* which connect two radially adjacent inlet openings 8*a*, 8*b* to one outlet opening 9, the fluid conducted through the jet disk 4 has a different jet outlet direction Sa, Sb imparted to it after it emerges from the respective outlet opening 9 depending on whether the fluid passes to the respective outlet opening 9 through one, for example a radially inner, inlet opening 8*a* or through the other, for example a radially outer, inlet opening 8*b*. The jet outlet directions Sa, Sb are substantially parallel to the side wall regions 12*a*, 12*b* of the passage channels 10*a*, 10*b* because said side wall regions 12*a*, 12*b* serve as guide surfaces or flow-guiding surfaces along which the fluid is guided from the inlet side 4*a* to the outlet side 4*b* of the jet disk 4. Each pair of radially adjacent inlet openings 8*a*, 8*b* thus provides two possible jet outlet directions Sa, Sb for the associated outlet opening 9.

FIGS. 3 and 4 show two different rotary position situations of the control disk 2. In the position of FIG. 3, of the four inlet opening pairs which are visible in this sectional view and which are situated along a diameter line of the jet disk 4, the control disk 2, by way of its control slot pattern 13, opens up in each case the radially inner inlet opening 8*a* of the two radially inner inlet opening pairs and the radially outer inlet opening 8*b* of the two radially outer inlet opening pairs by way of the slot segments $\mathbf{13}_1$ and $\mathbf{13}_4$ respectively. This leads to a jet pattern S1 in which the outlet jets of the two radially outer outlet openings 9 emerge with a radially inwardly directed component, and the two radially inner outlet jets emerge with a radially outwardly directed component. In the position of FIG. 4, the control disk 2 opens up the inlet openings in a complementary manner with respect to FIG. 3, that is to say the radially outer inlet openings 8*b* of the two radially inner inlet opening pairs and the radially inner inlet openings 8*a* of the two radially outer inlet opening pairs are opened up by way of the slot segments $13_2$ and $13_3$ respectively, and the other inlet openings are covered. This leads to a jet pattern S2 in which the two radially outer jets emerge with a radially outwardly directed component, and the two radially inner jets emerge with a radially inwardly directed component.

During operation, the fluid, such as water if the shower head is used for a sanitary shower device, passes via the inlet 7 into the interior of the shower head housing 1, sets the control disk 2 in continuous rotation in the process owing to the turbine blade structure 3 of said control disk, and passes through the slots of the control slot pattern 13 into the respectively opened-up inlet openings 8 of the jet disk 4 and through the passage channels 10*a*, 10*b* thereof to the outlet openings 9, in order to emerge from there with a shower jet characteristic that varies with time correspondingly to the rotating control disk 2, as explained above. During every full rotation of the control disk 2, the specific coordination of the control slot pattern 13 and of the inlet openings 8 in conjunction with the assignment of in each case two radially adjacent inlet openings 8*a*, 8*b* to a common outlet opening 9 via the associated passage channels 10*a*, 10*b* with non-parallel side wall regions gives rise to in each case two different outflow directions Sa, Sb for each outlet opening 9.

Furthermore, by means of corresponding dimensioning and arrangement of the various slot segments $13_1$ to $13_4$ of the control slot pattern 13, it is possible to set a desired defined temporal sequence of the present jet direction for the various outlet openings 9 with respect to one another, as is clear from the above explanations relating to FIGS. 3 and 4. The overall result is thus a variation with time of the shower jet characteristic for the fluid emerging from the shower head via the outlet openings 9, without the need for any movable jet outlet elements for this purpose. Instead, the arrangement of the control disk 2 so as to be movable relative to the jet disk 4 is sufficient, said control disk being the only movable element of the shower head in the exemplary embodiment shown in FIGS. 1 to 5. Alternatively, movable jet outlet elements may self-evidently additionally be provided if required. In further alternative embodiments, the jet disk may form the element that is actively set in rotation, with the control disk remaining static.

FIGS. 6 to 10 show a second shower head according to the invention, which constitutes a variant of the first shower head, wherein, for easier understanding, identical and functionally equivalent elements are denoted by the same reference signs as for the first shower head, and in this regard, reference can be made to the above description relating to FIGS. 1 to 5.

By contrast to the first shower head, it is the case in the second shower head that in each case two adjacent inlet openings 8*a*, 8*b* correspond individually to two correspondingly adjacent outlet openings 9*a*, 9*b*, wherein separate passage channels 14*a*, 14*b* are provided for connecting each inlet opening 8*a*, 8*b* to its corresponding outlet opening 9*a*, 9*b*. In this exemplary embodiment, the passage channels 14*a*, 14*b* extend as rectilinear bores from the respective inlet opening 8*a*, 8*b* to the respective outlet opening 9*a*, 9*b* through a jet disk 4' which is modified in this regard. Thus, in the case of this shower head, the number and arrangement of the outlet openings 9 correspond to those of the inlet openings 8, as can also be seen from FIGS. 6 and 7. The control disk 2 corresponds, with its integrated turbine blade structure 3 and the control slot pattern 13, to that of the first shower head.

The jet pattern variation with time is realized in the case of the shower head of FIGS. 6 to 10, analogously to the situation in the first shower head, in that, as the control disk 2 rotates, the control slot pattern 13 thereof, by way of the various slot segments $13_1$ to $13_4$, opens up and blocks the two inlet openings 8*a*, 8*b* of each pair of radially adjacent inlet openings in an alternating, that is to say successive, manner, such that as a result, the fluid emerges alternately from one and from the other of the two corresponding, radially adjacent outlet openings 9*a*, 9*b*. FIGS. 8 and 9 show longitudinal sections at two moments in time at which, for the four inlet opening pairs shown, firstly one and secondly the other inlet opening is opened up, leading to correspondingly different jet patterns S3 and S4.

In other words, in the case of this shower head, the variation with time of the shower jet characteristic for each pair of radially adjacent inlet openings 8*a*, 8*b* arises in that the fluid jet emerges in a periodically alternating manner from one or from the other of the two corresponding adjacent outlet openings 9*a*, 9*b*, whereas in the case of the first shower head of FIGS. 1 to 5, the jet pattern variation is based on a change in the direction in which the fluid jet emerges from the respective common outlet opening 9. Otherwise, the functional characteristics and advantages mentioned above with regard to the first shower head apply in the same way to the second shower head.

FIGS. 11 to 18 show a third shower head according to the invention, wherein again, for easier understanding, identical or functionally equivalent elements are denoted by the same reference signs as in the two shower heads of FIGS. 1 to 10. Said third shower head differs from the two shower heads discussed above substantially by a jet disk 4" with a modified pattern of the inlet and outlet openings 8, 9, and by the presence of a blocking mechanism for the selective blocking of the control disk rotary movement in one of two blocking positions which correspond to different shower jet patterns.

Specifically, the jet disk 4" has the passage channels 10*a*, 10*b* with the non-parallel side wall regions of the first shower head of FIGS. 1 to 5 for connecting in each case two radially adjacent inlet openings 8*a*, 8*b* to a common outlet opening 9, as can be seen in particular from FIGS. 16 to 18, but the inlet openings 8 and thus also the corresponding outlet openings 9 in the case of this shower head are not arranged so as to be distributed over the entire circumference of the jet disk inlet side 4*a*, but rather are restricted to two opposite sectors which each extend over an angle range of approximately 90°. Corresponding therewith is a modified control slot pattern 13', which is in turn composed of slot segments extending over in each case 90°, which slot segments, in terms of their mutual arrangement relative to the control slot pattern 13 of the first and second shower heads, are modified such that, as the control disk 2 rotates, the shower jet characteristic alternates between the two jet patterns S5, S6 shown in FIGS. 17 and 18.

The said blocking mechanism makes it possible, in the case of the third shower head, for the control disk 2 to be blocked against further rotation, and thus for said control disk to be immobilized selectively in the position of FIG. 17, with the jet pattern S3, or in the position of FIG. 18, with the jet pattern S4, according to user demand. Specifically, the blocking mechanism is designed, so as to be manually actuable, as a combined push/turn mechanism, such as is known for example from ball-point pens. For this purpose, the blocking mechanism has a blocking/actuation pin 15 with a suitably profiled pin head 16 which is guided in a recess 17 on the inlet side 4*a* of the jet disk 4" and which is acted on by a pushbutton 18, the latter being inserted from the outside into a recess 19 on the outer side of the jet disk 4" and being connected to the pin head 16.

The actuation pin 15 extends eccentrically through the central opening 6 of the control disk 2 and is supported resiliently elastically, by way of a helical spring 20, against the inner side of the upper part of the shower head housing 1. For this purpose, the spring 20 is held at one side against a foot part 21 of the actuation pin 15 and at the other side against a bearing projection 22 of the housing inner side. When the user presses the pushbutton 18, the latter moves the actuation pin 15 axially forward, or upward in FIGS. 11 to 18, counter to the force of the helical spring 20. The axial movement of the actuation pin 15 effects a rotation of the actuation pin 15 through 90° as a result of interaction of the profiled pin head 16 with a corresponding profile in the head receptacle 17 of the jet disk 4". When the pushbutton 18 is released, the helical spring 20 pushes the actuation pin 15 together with pushbutton 18 axially back into the initial position, wherein, during said axial return movement, the actuating pin 15 remains in its rotary position assumed as a result of the preceding axial forward movement.

On its circumference, the actuating pin 15 is equipped, between the head part 16 and the foot part 21, with two radially projecting blocking stops 23, 24 which are arranged so as to be offset relative to one another by approximately 90° in the circumferential direction and by more than their axial extent in the axial direction, such that said blocking stops do not overlap either in the circumferential direction or in the axial direction.

Correspondingly to said blocking stops 23, 24, two of the turbine blades 3 have in each case one blocking lug 25, 26 extending radially inward as far as the central opening 6. The other turbine blades end at a radial distance from the central opening 6, as can be seen in FIGS. 11, 14 and 15, or duly extend as far as the central opening 6, as indicated in FIGS. 16 to 18 which are slightly modified in this regard, but have only an axial height which is so small that they cannot come into blocking contact with the blocking stops 23, 24, arranged axially thereabove, of the actuating pin 15. Specifically, a first turbine blade **3*a* has a lower blocking lug 25 which interacts with the blocking stop 23 that is situated lower down in FIGS. 11 to 18, that is to say closer to the head part 16. Said blocking lug 25 ends, in the axially upward direction, before the blocking stop 24 which is situated further above, that is to say closer to the foot part 21, such that said blocking lug 25 does not interact with said blocking stop 24 so as to block the control disk rotary movement. A second turbine blade 3*b* has an upper delimiting lug 26 which interacts with the upper delimiting stop 24 of the actuation pin 15 and which, in an axially downward direction, ends before the lower delimiting stop 23. In this way, the turbine blade 3*b*, on its radially inner side, interacts by way of its upper blocking lug 26 only with the upper blocking stop 24 of the actuation pin 15, whereas, regardless of the rotational position of the actuation pin 15, said turbine blade does not interact with the lower blocking stop 23** of said actuation pin.

As can be seen from FIGS. 13 to 18, the actuation pin 15 is arranged in the center region of the shower head with a predefinable transverse offset Q with respect to the longitudinal center of the shower head, that is to say the longitudinal axis 27 of said actuation pin is offset in parallel with respect to the shower head longitudinal axis 11 by the corresponding dimension Q. Said offset is coordinated with the radial extent of the blocking stops 23, 24 and of the corresponding blocking lugs 25, 26 such that the respective blocking stop 23, 24 interacts with the corresponding blocking lug 25, 26, so as to generate a blocking action, always only when the actuation stop 23, 24 is situated on that side of the actuation pin 15 which faces diametrically away from the shower head longitudinal central axis 11. The respective blocking stop 23, 24 can be moved into said position by way of the described combined axial/rotational movement.

FIG. 16 shows the actuation pin 15 in a rotational position in which neither of its two blocking stops 23, 24 assumes a blocking position on the side facing away from the shower head longitudinal central axis 11. Consequently, in this position of the blocking pin 15, the control disk 2 with its turbine blade structure 3 can rotate freely. Here, the control disk 2 is supported radially toward the outside and axially in the upward direction on the housing 1, and axially in the downward direction on the jet disk 4", whereas in this case, the central opening 6 of said control disk serves merely for the leadthrough of the actuation pin 15, and not for mounting on a central bearing projection of the jet disk. Thus, in the actuation pin position of FIG. 16, the control disk 2 rotates continuously during operation, resulting in the above-mentioned variation with time of the shower jet characteristic in the form of alternation between the jet patterns S3 and S4 as per FIGS. 17 and 18.

If, proceeding from this release position of the blocking mechanism, the user actuates the pushbutton 11 once, the actuation pin 15 subsequently assumes a position rotated through 90° counterclockwise, as shown in FIG. 17. In this position, the upper blocking stop 24 is situated in its blocking position facing away from the shower head longitudinal axis 11. As a result, said blocking stop blocks the rotation of the control disk 2 when the respective turbine blade **3*b* comes into contact, by way of the upper blocking lug 26, with said upper blocking stop 24, as illustrated in FIG. 17. The control disk 2 thereupon comes to a standstill in said position, such that the fluid then emerges from the shower head with the static jet pattern S3**, with no variation with time.

If the user thereupon actuates the blocking mechanism once again by means of the pushbutton 18, the actuation pin 15 arrives in its position rotated still further counterclockwise by approximately 90°, as shown in FIG. 18, in which position the lower blocking stop 23 assumes its blocking position facing away from the shower head longitudinal central axis 11. In said blocking position, the lower blocking stop 23 interacts with the lower blocking lug 25 of the respective turbine blade **3*a* so as to generate a blocking action. At the same time, owing to the further rotation of the actuation pin 15, the upper blocking stop 24 passes from its previous blocking position into its release position, whereby its blocking interaction with the upper blocking lug 26 is eliminated. The control disk 2 consequently rotates further out of its blocking position of FIG. 17 until the turbine blade 3*a* comes into contact, by way of its lower blocking lug 25, with the lower blocking stop 23 of the actuation pin 15. The rotation of the control disk 2 thereupon stops again, and the shower head delivers the other jet pattern S4 of FIG. 18** as a constant shower jet characteristic.

By pressing the pushbutton 18 again, the user can again eliminate the blocking position of FIG. 18 with the static jet pattern S4. Owing to the further rotation of the actuation pin 15, again through approximately 90°, effected by the push-action actuation, the lower blocking stop 23 passes into its release position in which it no longer interacts with the lower blocking lug 25 of the turbine blade **3*a*. On the other hand, as a result of said further rotation of the actuation pin 15, the upper delimiting stop 24 remains in its release position, such that the control disk 2 can then rotate freely again. In other words, by a single actuation of the blocking mechanism, the user switches from the blocking position of FIG. 18** into the release position in which the freely and continuously rotating control disk serves to provide the described alternation between the jet patterns S3 and S4.

FIGS. 19 to 28 illustrate a fourth shower head according to the invention which, aside from a variant of the blocking mechanism, corresponds to the third shower head according to the invention of FIGS. 11 to 18, wherein again, the same reference signs are used for identical and functionally equivalent elements, and in this respect reference can be made to the above description relating to the first to third shower heads.

In the case of the shower head of FIGS. 19 to 28, the blocking mechanism for blocking the control disk rotary movement includes a blocking/actuation pin 28 which is inserted, for encircling rotary movement, into an edge-side through bore 33 of a jet disk $\mathbf{4}_1$ which is modified in this respect in relation to the jet disk 4" of the third shower head. For this purpose, the jet disk $\mathbf{4}_1$ has a protuberance 33*a* on its circumference, in the region of which protuberance the through bore 33 is situated and against the axial outer side of which protuberance bears a knurled head 29 of the actuation pin 28, by means of which knurled head a user can rotate the actuation pin 28. For this purpose, the knurled head 29 protrudes radially slightly beyond the circumference of the shower head housing 1 and of the jet disk $\mathbf{4}_1$.

The actuation pin 28 projects by way of a foot part 28*a* into a side wall region of the housing 1, for which purpose the housing side wall has a matching recess 32 in which the foot part 28*a* of the actuation pin 28 is received. At its foot part 28*a*, the actuation pin 28 is equipped, similarly to the actuation pin 15 of the third shower head, with two blocking stops 30, 31 which project radially from the circumference and which are arranged at 90° in the circumferential direction and one behind the other in the axial direction. The recess 32 on the side wall of the housing 1 is dimensioned such that the blocking stops 30, 31 of the actuation pin 28 can rotate unhindered therein when the actuation pin 28 is rotated.

In the case of this fourth shower head, the blocking function is realized in that each of the two blocking stops 30, 31 of the actuation pin interacts, with blocking action, with the radially outer side of in each case one of the turbine blades of a turbine blade structure 3', which is modified in this regard, of the control disk 2. Specifically, a turbine blade 3'*a* interacts with the blocking stop 31, which is at the foot side in the axial direction and which is the upper blocking stop in the figures, when said blocking stop 31 is situated in a radially inwardly pointing position, and a turbine blade 3'*b* interacts with the blocking stop 30, which is the lower blocking stop in the figures and which is closer to the knurled head 29, when said blocking stop 30 is situated in its radially inwardly pointing position.

For this purpose, all of the other turbine blades 3' are equipped, on their radially outer side, with a first, relatively broad recess 34 which is dimensioned such that the turbine blades 3' equipped with said recess 34 rotate freely past the actuation pin 28 in any position of the latter, even if one of the blocking stops 30, 31 of said actuation pin is situated in the radially inwardly pointing blocking position. Here, the blocking stop 30, 31 passes in each case through the recess 34 which, for this purpose, extends axially at least over the entire axial length of both blocking stops 30, 31. By contrast, the turbine blade 3'*a* has, on its radial outer side, a relatively narrow, lower recess 34*a* which is dimensioned such that, although the lower blocking stop 30 can pass through said recess 34*a* when said lower blocking stop is situated in its radially inwardly pointing blocking position, the upper blocking stop 31 cannot. Similarly, the turbine blade 3'*b* is equipped with an upper, relatively narrow recess 34*b* which is dimensioned such that, although the upper blocking stop 31 of the actuation pin 28 can pass through when said upper blocking stop is situated in its radially inwardly pointing blocking position, the lower blocking stop 30 cannot.

This configuration yields the following mode of operation of said blocking mechanism. In a release position as illustrated in FIGS. 23 and 24, the actuation pin 28 is situated in a rotary position in which neither of its two blocking stops 30, 31 assumes its radially inwardly pointing blocking position, and instead both blocking stops 30, 31 are situated within the recess 32 of the housing side wall without projecting radially inwardly from the housing side wall. As a result, the turbine blade structure 3', and with it the control disk 2, can collectively rotate unhindered, with the result that, in this operating mode of the shower head, the above-explained variation with time of the shower jet characteristics is obtained.

If, proceeding from said state, the user, during operation of the shower head, wishes to maintain one of the various shower jet characteristic in a constant state, he can for this purpose rotate the actuation pin 28, by way of its knurled head 29, into a corresponding blocking position. FIGS. 25 and 26 illustrate a blocking position in which the turbine blade 3'*a* interacts with the radially inwardly pointing, upper blocking stop 31 so as to generate a blocking action. For this purpose, the user rotates the actuation pin 28 clockwise through 90° proceeding from the release position shown in FIGS. 23 and 24. Whereas all of the other turbine blades 3' and 3'*b* can rotate freely past the radially inwardly pointing blocking stop 31, the turbine blade 3'*a* abuts against the blocking stop 31, whereby the rotary movement of the control disk 2 is stopped. The turbine blade 3'*a* is selected such that, in said blocking position, the control disk 2, by way of the associated slot segments $\mathbf{13'}_1$, $\mathbf{13'}_3$, opens up in each case the radially inner inlet openings 8*a* of the inlet openings 8*a*, 8*b* that are adjacent to one another in pairs, thus giving rise to the outlet jet pattern S6, similarly to FIG. 18 in the case of the third shower head.

If the actuation pin 28 is rotated onward once again through 90° clockwise, it assumes its second blocking position, in which its lower blocking stop 30 points radially inward and it is abutted against by the turbine blade 3'*b*, as shown in FIGS. 27 and 28, whereas all of the other turbine blades 3' and 3'*a* can freely pass the radially inwardly pointing blocking stop 30. The turbine blade 3'*b* is in turn selected such that the control disk 2, which is held stationary in said second blocking position, permanently produces the outlet jet pattern S5, analogously to FIG. 17 in the case of the third shower head, by virtue of the corresponding slot segments $\mathbf{13'}_2$, $\mathbf{13'}_4$ of the control slot pattern 13' each case opening up the radially outer inlet opening 8*b* of the inlet openings 8*a*, 8*b* arranged radially adjacent in pairs.

If the blocking pin 28 is once again rotated further clockwise through 90°, the two blocking stops 30, 31 are then again situated within the recess 32 of the housing side wall without protruding radially inward, that is to say the blocking mechanism is again situated in its release position in which the control disk 2 can rotate unhindered in order to realize the desired variation with time of the shower jet characteristic.

FIGS. 29 to 31 illustrate a fifth shower head according to the invention, wherein again, identical and functionally equivalent elements are denoted by the same reference signs as for the above-described shower heads of FIGS. 1 to 28, such that in this regard, reference can be made to the explanations given above.

The shower head of FIGS. 29 to 31 has a modified housing 1' with a fluid inlet 7' provided centrally on its upper face side and with an integrated flow-guiding structure 1'*a*, by means of which the fluid entering axially via the inlet 7' is diverted in a direction with a circumferential direction component. A flow-guiding structure 1'*a* of said type is known per se to a person skilled in the art, and requires no further explanation here.

As a further modification to the shower heads discussed above, in the case of the shower head of FIGS. 29 to 31, the turbine blades are provided on a turbine wheel 3" which, in this example, is formed as a component separate from a control disk $\mathbf{2}_1$. The turbine wheel 3" is coupled to the control disk $\mathbf{2}_1$ by way of a speed-reduction gearing in the form of a planetary gearing. The planetary gearing has an outer internal gear 35 which is formed on an inner circumference of the control disk $\mathbf{2}_1$, the latter being of ring-shaped form in this exemplary embodiment, a sun gear 36 arranged on the face side of the turbine wheel 3", and an interposed planet gear 37. The turbine wheel 3" is, by way of its sun gear 36, mounted in rotatably movable fashion onto a bearing journal 38 which projects centrally from the jet disk $\mathbf{4}_2$, and the planet gear 37 is mounted onto a bearing stud 39 arranged eccentrically on the inner side of the jet disk $\mathbf{4}_2$. Three holding lugs 1'*b* arranged at 120° intervals on the inner side of the housing side wall hold the ring-shaped control disk $\mathbf{2}_1$ in rotatably movable fashion at its outer side on the jet disk $\mathbf{4}_2$.

The control disk $\mathbf{2}_1$ is equipped with a control slot pattern composed of multiple control slots 40 which are arranged in succession in the circumferential direction and which are of identical form. Specifically, each control slot 40 has a radially inner section 40*a*, a radially outer section 40*b*, and an interposed transition section 40*c*. The radially inner section 40*a* and the radially outer section 40*b* run in each case at a constant radius over a predefinable circumferential angle range, and the transition region 40*c* runs between said two end-side slot sections 40*a*, 40*b*, and consequently with an additional radial component.

The jet disk $\mathbf{4}_2$, on its inner side, has slot-shaped inlet openings 8' with a radially running longitudinal axis, and on its outer side, has a substantially circular outlet opening 9 correspondingly to each inlet opening 8'. The inlet openings 8' are provided one behind the other in the circumferential direction on the jet disk $\mathbf{4}_2$, as are the outlet openings 9, that is to say the outlet openings 9 lie at the same radius. The respective outlet opening 9 is connected to the associated slot inlet opening 8' by way of a passage channel 10 which has a cross section which, in a jet disk radial plane, narrows conically from the inlet opening 8' toward the outlet opening 9.

In other words, in this exemplary embodiment, each slot inlet opening 8' corresponds via the passage channel 10, which owing to its conical form again has non-parallel side wall regions 12*a*, 12*b* for providing different jet outlet directions, with an outlet opening 9 such that a radially inner region 8'*a* of the inlet opening 8' is connected to the associated outlet opening 9 via the side wall region 12*a* with radially outwardly pointing direction component, and a radially outer region 8'*b* of the inlet opening 8' is connected to the associated outlet opening 9 via the side wall region 12*b* with radially inwardly running component. The inclined, conical side wall regions 12*a*, 12*b* of the passage channel 10 thus again form flow-guiding surfaces by means of which the fluid emerges from the outlet opening 9 in different jet directions, specifically with a radially outwardly or radially inwardly pointing jet direction component, depending on whether said fluid is supplied via the radially inner region 8'*a* or via the radially outer region 8'*b* of the respective inlet opening 8'.

The control slots 40 are coordinated with the slot inlet openings 8' such that said control slots, by way of their radially inner section 40*a*, open up the radially inner region 8'*a* of the inlet openings 8', and, by way of their radially outer section 40*b*, open up the radially outer region 8'*b* of the inlet openings 8'. The transition section 40*c* of each control slot 40 has the effect that the fluid supply into the passage channel 10 transitions in continuous fashion from the radially inner region 8'*a* to the radially outer region 8'*b* of the inlet openings 8'. By contrast, the change from the outer radius to the inner radius takes place abruptly by way of the change from one to the next control slot 40, wherein the control slots 40 do not overlap in the circumferential direction.

During operation, the fluid, such as for example water in the case of a sanitary shower head, passes via the inlet 7' into the shower head housing 1' and, there, by way of the flow-guiding structure 1'*a*, is directed with a circumferential direction component toward the blades of the turbine wheel 3", whereby the turbine wheel 3" is set in rotation. The planetary gearing 35, 36, 37 converts the turbine wheel rotation into a reduced-speed rotation of the control disk $\mathbf{2}_1$ relative to the jet disk $\mathbf{4}_2$, which is static on the housing 1'. The fluid passes radially out of the region of the turbine wheel 3" into that region of the rotating control disk $\mathbf{2}_1$ which is equipped with the control slot pattern 40, and said fluid emerges through the control slots 40 via the respectively opened-up radially inner or radially outer region 8'*a*, 8'*b* of the inlet openings 8' into the passage channels 10, and emerges from these at the outlet side of the jet disk $\mathbf{4}_2$, via the outlet openings 9 thereof, with a jet direction that is variable with time.

FIG. 31 illustrates, in a longitudinal sectional view, a moment in time at which a left-hand inlet opening is opened up in its radially outer region 8'*b* by the radially outer control slot pattern section 40*b*, whereby the fluid emerges with a radially inwardly directed component from the associated outlet opening, whereas a diametrically opposite inlet opening is opened up in its radially inner region 8'*a* by the radially inner section 40*a* of the control slot pattern 40, such that there, the fluid emerges with a radially outwardly directed component from the associated outlet opening 9. Altogether, this results in a present jet pattern S7.

When the control disk $\mathbf{2}_1$ has rotated slightly further, until the inlet opening on the left in FIG. 31 is opened up in its radially inner region 8'*a*, and correspondingly, the opposite inlet opening is opened up in its radially outer region 8'*b*, this yields the jet pattern S8, which differs from the jet pattern S7 and in the case of which the fluid emerges from the left-hand outlet opening with a radially outwardly directed component and from the right-hand outlet opening 9 with a radially inwardly directed component. The continuous, fluid-driven rotation of the control disk $\mathbf{2}_1$ thus in turn yields the desired variation with time of the shower jet characteristic, which is defined by the coordination of the control slot pattern 40, on the one hand, and the inlet openings 8', on the other hand, in terms of shape and arrangement. Depending on the number and shaping of the control slots 40, and depending on the selection of the speed reduction by way of the planetary gearing 35, 36, 37, it is possible to generate different shower jet characteristics in a desired temporal sequence with abrupt or uniform, overlapping transitions as desired.

In this regard, FIGS. 32 to 34 show a sixth shower head according to the invention with a control slot configuration that differs from that of the fifth shower head. The sixth shower head otherwise corresponds to the fifth shower head described above, such that below, only the differences need to be discussed, and reference is otherwise made to the above explanations regarding the fifth shower head.

Specifically, the shower head of FIGS. 32 to 34 comprises a control slot pattern on a control disk $\mathbf{2}_2$ which is modified in this regard and which has a plurality of rectilinear control slots 41, which in turn are arranged one behind the other in the circumferential direction without an overlap. Here, each control slot 41 runs in the circumferential direction and additionally with a uniform radial component such that said control slot lies with a radially inner end 41*a* at the radius of the radially inner regions 8'*a* of the inlet openings 8', and with a radially outer end 41*b* at the radius of the radially outer regions 8'*b* of the inlet openings 8'. In this way, each control slot 41 opens up the respective slot inlet opening 8' in continuous fashion from its radially inner region 8'*a* to its radially outer region 8'*b* or vice versa, depending on the direction of rotation, followed by an abrupt change to the next control slot 41. This control slot pattern 41 consequently yields, for the respective outlet opening 9 of the jet disk $\mathbf{4}_2$, a relatively continuous transition from one to the other jet pattern, followed by an abrupt return to the first jet pattern.

Depending on the number and arrangement of the control slots 41 and of the inlet openings 8', it is possible, for the entirety of the outlet openings 9 at a respective point in time, to set identical jet directions synchronously or different jet directions in grouped fashion or different jet directions in irregularly distributed fashion, which jet directions together yield the respectively present jet pattern of the shower head. In the example shown in FIGS. 32 to 34, eight control slots 41 are provided, as can be seen in particular from FIG. 34, which control slots extend in the circumferential direction over approximately the angular interval of the inlet openings 8', such that each slot 41 always opens up a subsequent inlet opening 8' in its radially inner or outer region approximately when said slot leaves a previous inlet opening 8'. As can likewise be seen from FIG. 34, each control slot 41 extends over the respective inlet opening 8', depending on the direction of rotation, with a continuous transition from its radially inner region 8'*a* to its radially outer region 8'*b* or vice versa, so as to yield a highly continuous transition from one to the other jet pattern, followed by an abrupt jet pattern change upon the transition from one to the next control slot 41.

FIG. 33 illustrates a moment in time corresponding to FIG. 31 for said control slot variant. Here, a left-hand inlet opening in FIG. 33, and a diametrically opposite right-hand inlet opening in FIG. 33, are both opened up in their radially outer region 8'*b* by the associated control slots 41, such that the fluid entering said inlet openings emerges with a radially inwardly pointing component from the two associated outlet openings 9, thus contributing to a corresponding jet pattern S9. When the control disk $\mathbf{2}_2$ rotates onward, said jet pattern S9 changes in continuous fashion to a jet pattern S10 indicated by dashed lines, in the case of which the fluid enters through the radially inner regions 8'*a* of the two inlet openings shown and emerges with a radially outwardly pointing component from the associated outlet openings 9.

FIGS. 35 to 38 illustrate two further control disk variants with regard to the configuration of the control slot pattern, see in particular FIGS. 35 and 37, and a seventh and an eighth shower head according to the invention, respectively, see in particular FIGS. 36 and 38, equipped with said control disk variants, wherein said two shower heads otherwise correspond to the fifth and sixth shower heads of FIGS. 29 to 34, in particular as regards the realization of the shower head housing, the turbine wheel, the planetary gearing and the jet disk.

The embodiment as per FIGS. 35 and 36 comprises a ring-shaped control disk $\mathbf{2}_3$ with a control slot pattern composed of multiple control slots 42 arranged one behind the other in the circumferential direction, which control slots each extend over approximately twice the angular interval of the inlet openings 8' of the jet disk and have a curved contour with a central region 42*a*, which lies radially at the level of the radially inner regions 8'*a* of the inlet openings 8', and adjoining end sections 42*b*, 42*c*, at which the slot 42 transitions in continuous fashion to the radius of the radially outer regions 8'*b* of the inlet openings 8'. The control slots 42 are separated from one another by narrow radial web regions 43 of the control disk $\mathbf{2}_3$. The webs 43 hold the region of the control disk $\mathbf{2}_3$ radially outside the control slots 42 together with the region radially within the control slots 42. The webs 43 may be selected to be of any desired width, for example so as to have a width which is at most approximately equal to, or at most approximately two times, the width of the control slots 42. The narrower the webs 43 are, the shorter the time period during which they cover radially outer region 8'*b* of the respective inlet opening 8' and thus briefly disrupt the jet pattern.

In the case of the shower head as per FIGS. 35 and 36, the control slot pattern 42 ensures that, during operation, for each jet disk outlet opening, the jet direction changes continuously between the two jet patterns which are defined by the fluid inlet into the jet disk selectively through the radially inner region 8'*a* and the radially outer region 8'*b* of the inlet openings 8'. By contrast to the shower heads of FIGS. 29 to 34, in which only one jet direction change is continuous but the other is abrupt, a continuous jet direction change is obtained in both cases in the shower head of FIGS. 35 and 36.

The same applies to the shower head as per FIGS. 37 and 38. Said shower head has been modified in relation to that of FIGS. 35 and 36, with the sole difference being that the separation webs 43 have been replaced by narrow arcuate bridge elements 44. Accordingly, the shower head of FIGS. 37 and 38 has a modified control disk $\mathbf{2}_4$, the control slot pattern of which is composed of one control slot 45 which is continuous in the circumferential direction, and the profile of which corresponds to the profile defined by the entirety of the control slots 42 in the shower head of FIGS. 35 and 36, wherein, in the shower head of FIGS. 37 and 38, the interruptions by the separation webs 43 are omitted. Instead, the radially inner part and the radially outer part of the control disk $\mathbf{2}_4$ in relation to the continuous control slot 45 are held together by the bridge elements 44.

In terms of its function for the variation with time of the shower jet characteristic, the continuous control slot 45 substantially corresponds to the control slot pattern 42 in the case of the shower head of FIGS. 35 and 36, wherein, as the sole difference, there is no interruption of the opening-up of the radially outer region 8'*b* of a respective inlet opening 8' upon the transition from one control slot to a subsequent control slot. Rather, in the case of the shower head of FIGS. 37 and 38, said radially outer inlet opening region 8'*b* remains opened up even beneath the bridge elements 44 when the control disk $\mathbf{2}_4$ moves with one of the bridge elements 44 over said radially outer inlet opening region 8'*b*.

As is clear from the exemplary embodiments shown and explained above, the invention advantageously provides a shower head which makes it possible, by means of a control disk that is movable relative to a jet disk and by means of suitable coordination of a control slot pattern provided in the control disk and of inlet openings provided in the jet disk, which inlet openings correspond with jet disk outlet openings via suitable passage channels, to achieve a desired shower jet characteristic that varies with time, without the need to provide movable jet outlet elements for this purpose. For this purpose, the passage channels may be formed with oblique side walls as flow-guiding surfaces, and/or pairs of closely adjacent inlet openings and corresponding outlet openings may be provided which are fed with the fluid in alternating fashion.

The control disk may, by means of a suitable turbine blade structure, be driven by the in-flowing fluid itself. Provision may optionally be made of the illustrated speed-reduction planetary gearing, or of some other speed-increasing or speed-reduction gearing known per se for this purpose. Furthermore, in a manner which is not shown, a conventional rotational speed regulation means may be provided for the control disk, for example by way of a bypass past turbine drive nozzles, as described for example in the patent EP 0 900 597 B1. It is advantageously possible for the control disk to be stopped in a desired position as required such that a particular desired shower jet characteristic can be maintained in a constant state. In the case of the blocking mechanisms described, this is realized by means of a mechanical lock which interacts with suitably designed turbine blades. Alternatively, corresponding mechanical blocking means may be provided directly on the control disk rather than on the turbine blades. Depending on requirements, the blocking mechanism may be designed such that it can immobilize the control disk in its relative position with respect to the jet disk in two blocking positions, as shown, or alternatively in only one blocking position or in more than two blocking positions.

It is self-evident that the invention encompasses not only the examples shown by way of example but also encompasses numerous other embodiments, in particular also mixed forms of the examples shown in which features of said examples are combined, for example a jet disk with a pattern of outlet openings and inlet openings that differs from the patterns shown, and/or a control disk with a control slot pattern that differs from the control slot patterns shown, or a combination of the patterns shown.

The invention is particularly advantageously used for shower heads of sanitary shower devices. The invention is however self-evidently also suitable for all other applications in which there is a demand for a shower head with a shower jet characteristic that is variable with time.

The invention claimed is:

1. A shower head for a sanitary shower device, comprising:

a jet disk having inlet openings on one side of the jet disk and outlet openings on an other side of the jet disk and having in each case a passage channel connecting each said outlet opening to at least one said inlet opening, through which passage channel fluid can flow through the jet disk, and a control disk arranged upstream of the jet disk in a fluid flow direction, the control disk being rotatably movable relative to said jet disk, wherein the control disk has a control slot pattern having control slots through the control disk, wherein the control slots become aligned with the inlet openings, thereby connecting flow to the inlet openings, and become misaligned to block flow to the inlet openings, depending on a rotary position of the control disk, wherein the control slot pattern and the inlet openings are matched to one another in position such that during rotation of the control disk relative to the jet disk, alternating alignment and misalignment of the control slots and the inlet openings at different rotary positions of the control disk selects flow through different passage channels of pairs of passage channels that have at least one of adjacent inlet openings and adjacent outlet openings on the jet disk.

2. The shower head according to claim 1, wherein openings of the pairs of passage channels are adjacent to one another at different radial distances on the jet disk and the control slot pattern includes slot regions correspondingly disposed at said different radial distances.

3. The shower head according to claim 2, wherein the control slot pattern comprises at least two separate slot segments disposed at said different radial distances, which slot segments are assigned in each case to one of said openings of the pairs of passage channels.

4. The shower head according to claim 3, wherein the control slot pattern comprises a slot that is continuous in a circumferential direction and bridged by one of at least one bridge web, and slots extending in the circumferential direction and separated from one another by at least one separation web.

5. The shower head according to claim 1, wherein at least one said passage channel has a cross-section tapering conically towards the outlet opening in a jet disk radial plane.

6. The shower head according to claim 1, wherein the control disk is provided with a fluid flow driven turbine blade structure on an inlet side facing away from the jet disk.

7. The shower head according to claim 6, wherein the control slot pattern is radially outside of the turbine wheel.

8. The shower head according to claim 6, further comprising a planetary gearing having a sun wheel provided on the turbine wheel, an outer hollow wheel provided on the control disk, and a planetary wheel interposed therebetween.

9. The shower head according to claim 1, further comprising a blocking mechanism for blocking the control disk rotary movement in one of a first blocking position in which one of said two adjacent inlet openings is enabled, and a second blocking position in which the other said inlet opening is enabled.

10. The shower head according to claim 9, wherein the blocking mechanism includes a blocking pin movably attached to the jet disk, which blocking pin is successively switchable between at least three different positions, of which a first position enables rotary movement of the control disk, a second position defines the first blocking position, and a third position defines the second blocking position.

11. The shower head according to claim 3, wherein the slot segments include at least one slot extending in the circumferential direction and radial direction of the control disk, which slot is assigned to both of said openings of the pairs of passage channels.

12. The shower head according to claim 2, wherein the control slot pattern comprises at least two separate slot segments disposed at different radial distances, which slot segments include at least one slot extending in a circumferential direction and a radial direction of the control disk, which slot is assigned to both of said openings of the pairs of passage channels.

13. The shower head according to claim 1, wherein the control disk is coupled to a fluid flow driven turbine wheel via a gearing, which turbine wheel and gearing are arranged on a side of the control disk facing away from the jet disk.

14. The shower head according to claim 13, wherein the control slot pattern is radially outside of the gearing.

15. The shower head according to claim 13, wherein the gearing comprises a planetary gearing having a sun wheel provided on the turbine wheel, an outer hollow wheel provided on the control disk, and a planetary wheel interposed therebetween.

16. A shower head for a sanitary shower device, comprising:

a jet disk having at least one inlet opening on one side of the jet disk and at least one outlet opening on an other side of the jet disk and having in each case at least one passage channel connecting each said outlet opening to at least one said inlet opening, through which passage channel fluid can flow through the jet disk, and a control disk arranged upstream of the jet disk in a fluid flow direction, the control disk being rotatably movable relative to said jet disk, wherein the control disk has a control slot pattern having control slots through the control disk, wherein the control slots become aligned with the inlet openings thereby connecting flow to the inlet openings, depending on a rotary position of the control disk, wherein the control slot pattern and the inlet openings are matched to one another such that during rotation of the control disk relative to the jet disk, alternating alignment and misalignment of the control slots and the inlet openings at different rotary positions of the control disk selects flow through passage channels at different radial distances, and wherein the passage channels of the pairs of passage channels include passage channels with nonparallel sidewalls, respectively coupling said inlet and outlet openings such that an opening on one of an inlet and outlet side of the jet disk couples to an opening on an opposite of the inlet and outlet side of the jet disk such that the passage channels with nonparallel sidewalls alternately emit in two different jet outlet directions.

17. The shower head according to claim 1, wherein the alignment and misalignment of the control slots and the inlet openings at different rotary positions of the control disk includes rotary positions at which one of the control slots aligns with only one of two adjacent inlet openings coupled with one common outlet opening via two passage channels having non-parallel side walls, thereby selecting one of two different jet outlet directions.

18. The shower head according to claim 1, wherein the alignment and misalignment of the control slots and the inlet openings at different rotary positions of the control disk includes rotary positions at which one of the control slots aligns with a region of an inlet opening for directing flow at one of two different jet outlet directions through an outlet opening, through a passage channel having non-parallel side wall regions.

19. The shower head according to claim 1, wherein the alignment and misalignment of the control slots and the inlet openings at different rotary positions of the control disk includes rotary positions at which one of the control slots aligns with two adjacent inlet openings to correspond to two adjacent outlet openings.

20. The shower head according to claim 16, wherein the jet disk includes pairs of passage channels with said non-parallel sidewalls and pairs of passage channels with parallel sidewalls.

* * * * *